United States Patent [19]

Reina et al.

[11] Patent Number: 4,706,269

[45] Date of Patent: Nov. 10, 1987

[54] ANTI-SCATTER GRID STRUCTURE

[76] Inventors: Leo J. Reina, 103 S. River Rd., Fox River Grove, Ill. 60021; William J. Antolik, 1125 N. Grove Ave., Palatine, Ill. 60067

[21] Appl. No.: 881,184

[22] Filed: Jul. 1, 1986

Related U.S. Application Data

[63] Continuation-in-part of Ser. No. 710,280, Mar. 11, 1985, abandoned.

[51] Int. Cl.[4] ..... G21K 1/00

[52] U.S. Cl. ..... 378/154; 378/167; 378/181; 378/210

[58] Field of Search ..... 378/154, 155, 186, 185, 378/181, 167, 210; 250/482.1

[56] References Cited

U.S. PATENT DOCUMENTS

| | | | |
|---|---|---|---|
| 2,823,317 | 2/1958 | Fairbank | 378/185 |
| 4,039,841 | 8/1977 | Leighley | 378/154 |
| 4,132,897 | 1/1979 | Ohlson et al. | 378/154 |
| 4,380,087 | 4/1983 | Tanaka | 378/186 |
| 4,457,010 | 6/1984 | Jenkins et al. | 378/167 |
| 4,663,774 | 5/1987 | Saffer | 378/37 |

*Primary Examiner*—Carolyn E. Fields
*Assistant Examiner*—John C. Freeman
*Attorney, Agent, or Firm*—Charles F. Meroni, Jr.

[57] ABSTRACT

A method of manufacture of an anti-scatter grod structure for protectively housing a grid therein, the steps of cutting a solid upper and lower plates to a given size lightly larger than the cassette to be housed by the grid structure, forming a generally U-shaped frame structure with interior vertically spaced ledges with an upper ledge being sized for supporting the lower plate and with a lower ledge being vertically spaced therefrom and sized for under lapping the lower plate and supporting a cassette in assembly with the frame, securing the lower plate in assembly with the frame while engaged with the upper ledge, mounting a grid in centered relation on the lower plate and limiting the extent of shifting movement of the grid relative to the lower plate, positioning a solid upper plate over the grid in parallel relation to the lower plate, and securing the solid upper plate to the U-shaped frame structure in unitary assembly. An X-ray grid structure for assembly with a cassette comprising a rectangular, flat panel comprised of a polycarbonate material and having an interior closed panel pocket, an X-ray grid protectively encased in the interior panel pocket of the flat panel so as to be protected therein against impact forces when applied to the panel, a frame around three side edges of the panel, the frame being comprised of a UHMW plastic for cushioning impacts, means securing the frame to the flat panel along the three side edges but with the means being spaced from the grid at its outer peripheral edges, and a groove in the frame forming a cassette pocket beneath one flat side of the panel for a cassette to be slidably received in the cassette pocket to thereby form a grid cassette when assembled.

16 Claims, 16 Drawing Figures

FIG. 12
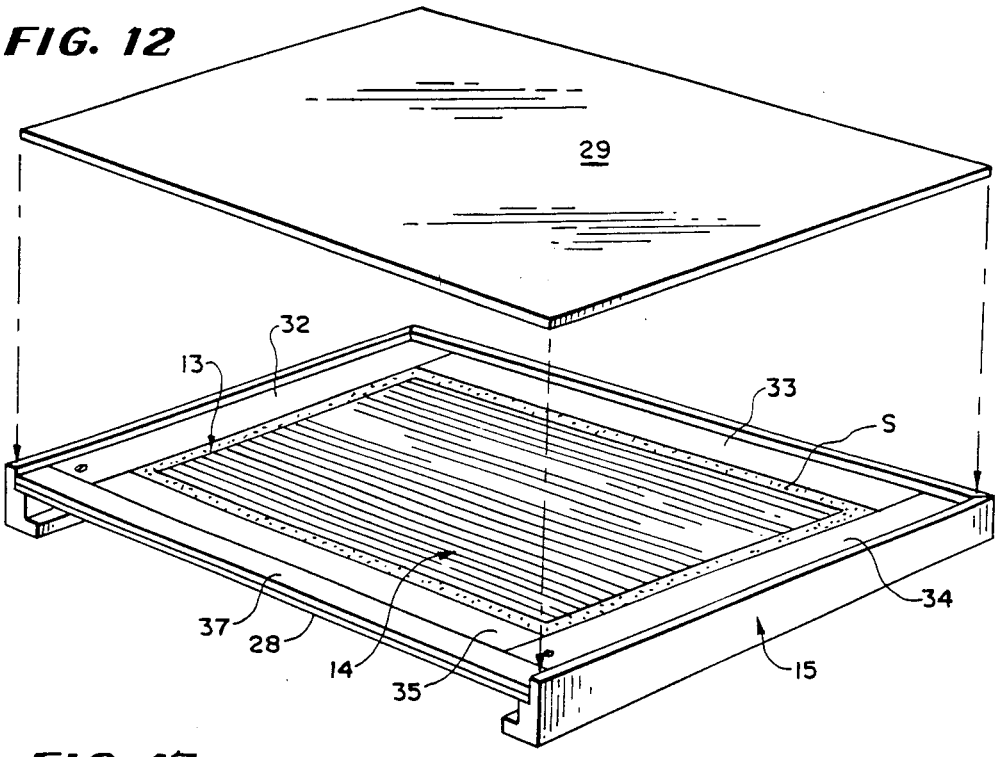
FIG. 13
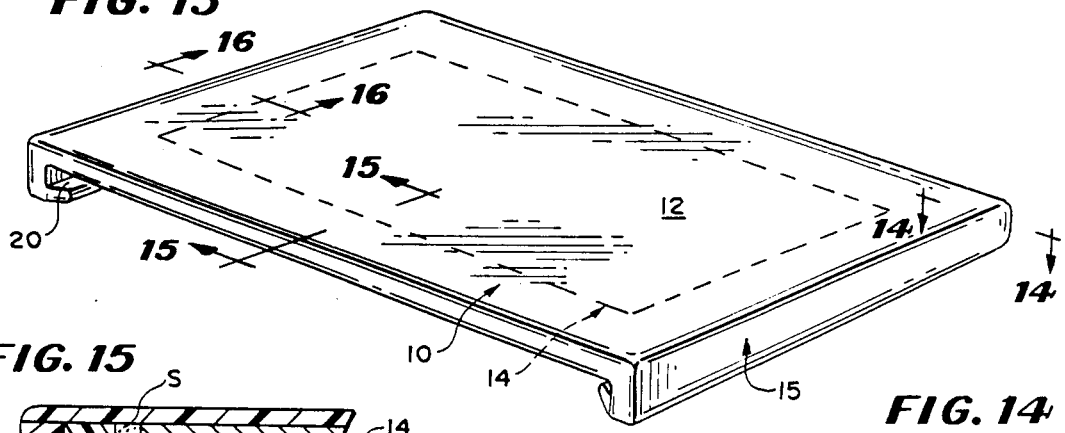
FIG. 15
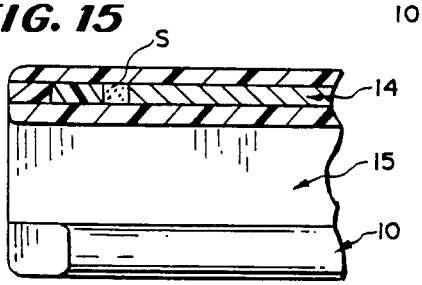
FIG. 14
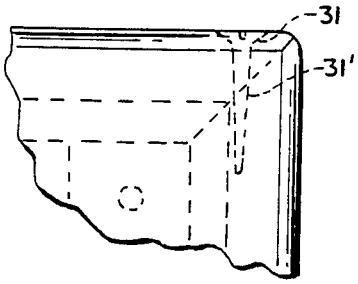
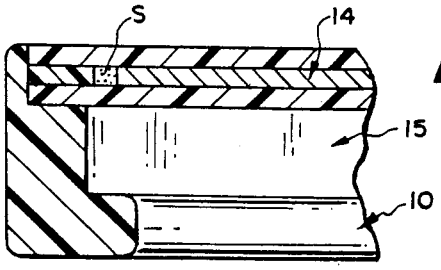
FIG. 16

ANTI-SCATTER GRID STRUCTURE

This is a contiuation-in-part, of application Ser. No. 710,280, filed Mar. 11,1985, now abandoned.

1. Background of the Invention Field of the Invention

This invention also relates to a new method of manufacturing an X-ray grid structure. The present invention relates to a new and improved X-ray grid structure for assembly with a cassette.

It is well known to those persons who are acquainted with the particular field, that products of this type currently on the market serve only to accommodate an X-ray cassette, but they do little or nothing for protection of the X-ray grid. In fact, they usually fall apart within two years from normal use. An X-ray grid may cost as much as fifteen hundred dollars apiece, and a damaged grid can produce unsatisfactory X-rays so that this situation is, accordingly, in need of improvement.

Therefore, it is a principal object of the present invention, to provide a protective Lexan encasement for an Xray grid, which gives a total protection thereto so as to extend the useful life of the grid as long a possible.

Another object is to provide a grid enclosure, which virtually eliminates the need for X-ray grid replacements due to accidental droppage.

Yet another object is to provide a grid enclosure which incorporates a UHMW plastic track so as to accommodate the X-ray cassette to further protect the X-ray grid.

In the prior art Ohlson U.S. Pat. No. 4,132,897 does not pertain to an X-ray grid structure for assembly with a cassette nor does it have the improved method and/or structural features further defined herein.

The Ohlson etal U.S. Pat. No. 4,132,897 is simply disclosed a cassette holder and it has nothing to do with a device for protecting an X-ray grid. It is simply a device that holds a cassette and used in conjunction with an X-ray table or apparatus. There are no protective measures on the Ohlson cassette holder for an X-ray grid. The cassette used in Ohlson tray simply holds the cassette in position and nothing more. The Ohlson holder is not a portable device as here disclosed. It is a fixed device.

Also the Ohlson device is an open metal holder. It does nothing more than hold the cassette. The center of the holder is open so the operator can shoot a radiograph through it, and that is all that it does. It is more of a centering device than it is anything else. It has nothing to do with an X-ray grid holder.

The Ohlson holder has a structural disability rendering it incapable to act as a grid holder. This film cassette holder has a circular hole which is of substantial diameter and this would not enable this grid holder or enclosure to protectively encase an X-ray.

There are other structural features that would disable the film cassette holder of Ohlson from functionally protecting an X-ray grid. The new and improved materials used in the manufacture of our X-ray grid structure are undisclosed in this patent. The rails are an open rail design and no provision is made for the grid placement. All it has is a placement for the cassette, so the grid would have to be laid on top of Ohlson holder leaving the grid vulnerable to damage.

No provision is made in the Ohlson cassette holder to enable a grid to be slidably engaged beneath these rails shown in the Ohlson holder. If the grid were slidably engaged with the cassette into the holder, then the holder would have to allow for the grid and the cassette. If it did provide enough space that both would have to be entered for each radiograph, then both would have to be removed afterwards. This in itself means that the grid would be moved in and out and held and then displaced from the cassette. The grid would then need to be put some place while that film is being replaced by another film. During all of this handling, the life of the grid would be endangered. With repeated disassembly of the grid its useful life would be materially reduced. Even today's grids are not handled this way anymore. The grids are either in cassettes or some type of a holder, and they remain permanently in the holders. The grids that are allowed to be moved back and forth and placed in other areas while the films are being changed do not last more than a couple of months.

U.S. Pat. No. 4,039,841 shows a device where the screws and the fasteners for securing the components go directly through the grid connecting the grid 14 to the rails 16 and 20, and the grid does extend to the outer borders, so that it is all grid. Whenever the device is dropped, the impact is distributed through the grid itself, so the grid sustains damage from any drop. In the presently disclosed X-ray grid structure, the fasteners do not penetrate or come close to the grid. Any impact that the presently claimed X-ray grid structure receives from a drop is distributed through the holder and its UHMW rail, which is a spongy type of material, and it actually bounces and absorbs the shock before the grid can be damaged. If the grid in the holder is ever damaged, it would be from a massive blow to it such that it would crush the X-ray grid structure itself. One of the inventive concepts here disclosed embodies the idea that the droppage impact is distributed through the holder and not the grid thereby lengthening the life of the grid compared with the prior art devices.

The X-ray grid structure has a far greater life than any other known device. Prior art devices have been found to have a useful life of only 12 to 18 months. With the prior art as with the 841' patent, the rails themselves that hold the cassette become so damaged and loosened that they are usually off the cassette or taped on, or repaired with rivets that someone in a shop tries to fit. By this time the grid itself starts to sustain damage around its borders because the rails are no longer taking any of the impact and the grid sustains the blows and pressures of use. This is just from every day hospital use by X-ray technicians, not from droppage. Generally, within 18 months the rails are off completely. The X-ray grid adaptor, as shown in the 841' patent, has a very limited life. With our new X-ray grid structure, the rails are permanent. They will not come off. In the field no one has been able to take a rail off, and the presently disclosed X-ray grid enclosure will last and last. If it should become damaged, the product is replaced.

It should be realized that a damaged grid can produce a distorted X-ray that can be misinterpreted because of the lead lines that run vertical through the grid. When they are displaced due to damage to the X-ray grid, they cause radiographic artifacts. The displaced lead lines super impose the anotomical views that have been radiographed. If it should impose over a rib or say, in the skull, it may be interpreted as a fracture and in many cases have been interpreted as such. With structural defects of this type radiologists are sued because the X-ray films are confusing and the radiologist misinterprets them because of the damaged grid and diagnoses an injury which the patient has not suffered.

In summary, it is very important the the grid be maintained in a damage free state. These grids require real protection. Our new X-ray grid structures and its new method of manufacture provides a vastly improved performance, and it has a far superior useful life over any other device of its kind.

Other objects and features are to provide a grid enclosure, which is simple in design, inexpensive to manufacture, rugged in construction, easy to use, and efficient in operation.

SUMMARY OF THE INVENTION

An X-ray grid structure for assembly with a cassette comprising a rectangular, flat panel comprised of a polycarbonate material and having an interior closed panel pocket, an X-ray grid protectively encased in said interior panel pocket of said flat panel so as to be protected therein against impact forces when applied to said panel, a frame around three side edges of said panel, said frame being comprised of a UHMW plastic for cushioning impacts, means securing said frame to said flat panel along the three side edges but with said means being spaced from the grid at its outer peripheral edges, and a groove in said frame forming a cassette pocket beneath one flat side of said panel for a cassette to be slidably received in the cassette pocket to thereby form a grid cassette when assembled.

An X-ray grid structure for assembly with a cassette comprising a rectangular, flat panel comprised of a polycarbonate material and having an interior permanently closed panel pocket, an X-ray grid protectively encased in said interior permanently closed pocket of said flat panel so as to be protected therein against impact forces when applied to said panel, a frame around three side edges of said panel, said frame being comprised of a UHMW plastic for cushioning impacts, means securing said frame to said flat panel along said three side edges, and a groove in said frame forming a cassette pocket beneath one flat side of said panel for a cassette to be slidably received in the cassette pocket to thereby form a grid cassette when assembled.

Further objects and features of our invention will also be apparent from the following description of preferred embodiments of our invention. The description is made with reference to the company drawings.

BRIEF DESCRIPTION OF THE DRAWING

FIG. 12 is an enlarged exploded view including the sub-assembly shown in FIG. 11, and with a top closure sheet shown in exploded position in readiness for attachment with the sub-assembly shown in FIG. 11.

FIG. 13 is a prospective view of the formed X-ray grid structure;

FIG. 14 is an enlarged fragmentary corner view of the X-ray grid structure as shown on the line 14—14 looking in the direction indicated by the arrows as seen in FIG. 13;

FIG. 15 is an enlarged fragementary corner view of the X-ray grid structure as shown on the line 15—15 looking in the direction indicated by the arrows as seen in FIG. 14;

FIG. 16 is an enlarged fragementary corner view of the X-ray grid structure as shown on the line 16—16 looking in the direction indicated by the arrows as seen in FIG. 15;

DESCRIPTION OF THE PREFERRED EMBODIMENTS

Figure 1:
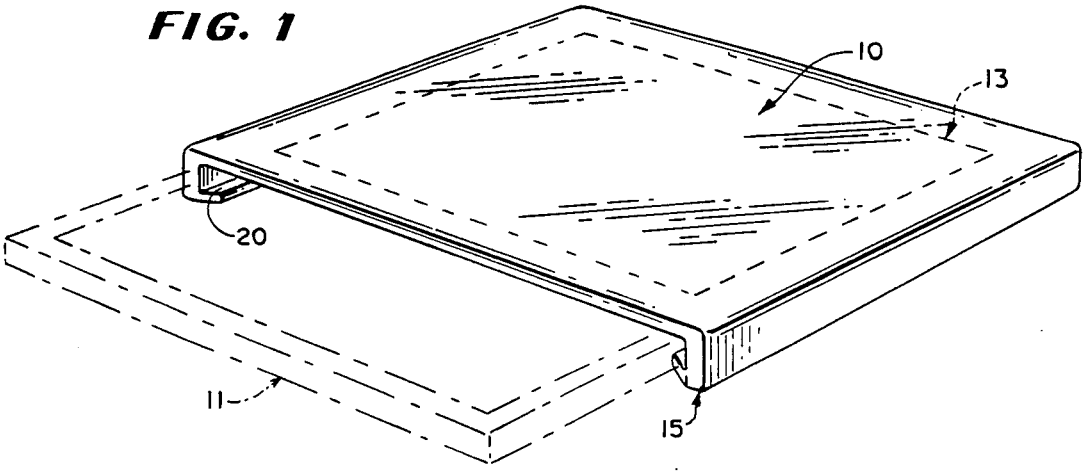
FIG. 1 is a prospective view of an X-ray grid structure and with dotted lines showing the way in which a cassette can be assembled to form an anti-scatter grid cassette.

The reference numeral 10, as seen in FIG. 1, designates generally an X-ray grid structure embodying important features of our invention. The structure that is shown in FIG. 1 is generally shown in our earlier filed copending U.S. application for patent entitled: "ANTI-SCATTER GRID CASSETTE", our case No. 86081-2, U.S. Ser. No. 671,028, filed Mar. 11, 1985.

The X-ray grid structure 10 is particularly constructed for assembly with an X-ray cassette 11. The X-ray grid structure 10 includes a flat panel 12 that is comprised of a polycarbonate material and has an interiorly located closed panel pocket 13 (FIG. 8) for receiving an X-ray grid 14 to protectively encase the grid against impact forces when applied to the panel such as where the panel might be dropped or given rough handling by an X-ray technician when being removed from storage or placed into storage.

Figure 2:
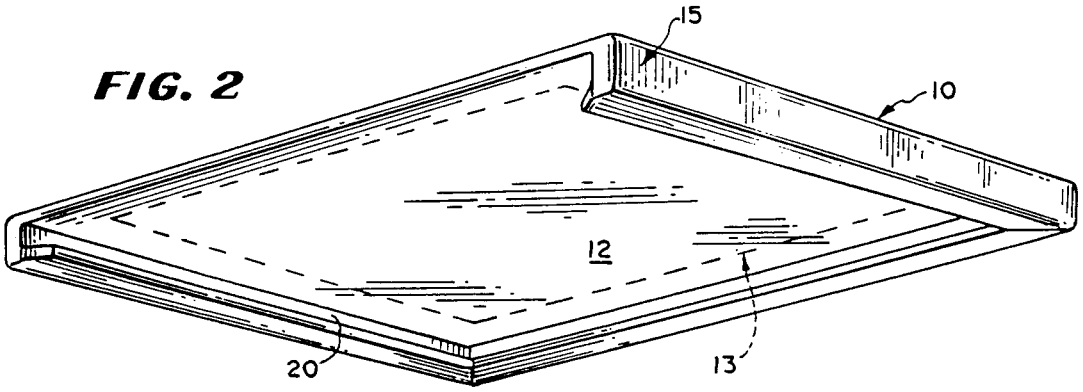
FIG. 2 is a bottom prospective view of the X-ray grid structure as seen in FIG. 1.
Figure 6:
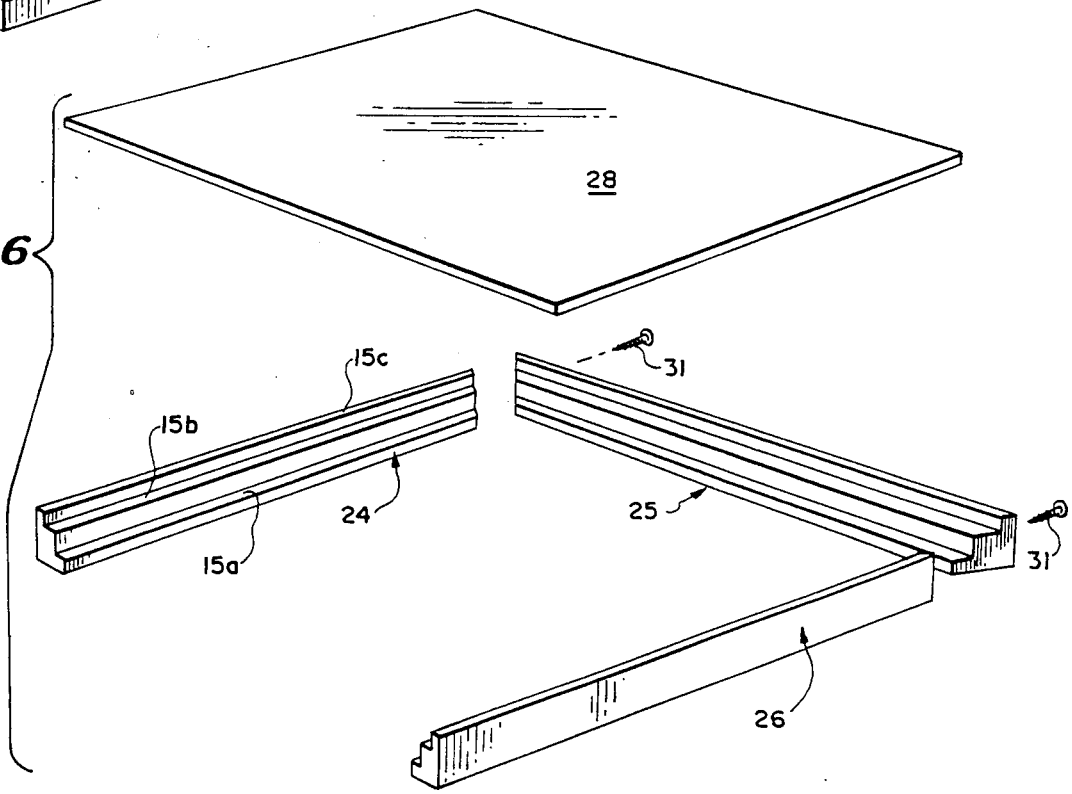
FIG. 6 is an enlarged exploded view showing the way in which the formed components illustrated in FIG. 3–5 can be positioned for assembly together.

A U-shaped frame 15 is provided around three side edges of the panel as seen in FIG. 1 and 2 and has stepped frame or rail ledges 15*a*, 15*b*, and 15*c* (FIG. 6). The frame 15 is comprised of a UHMW plastic for cushioning impacts. Fasteners or screws 16 are provided for securing the panel 14 to the frame 15 along the three side edges thereof. These fasteners or screws 16 are spaced from the grid 14 (FIG. 10) and its outer peripheral grid edges 17, 18 and 19 rather than extending through the grid so that impacts are transmitted to the frame 15 or the panel 12 will not be directly transmitted to the X-ray grid 14.

The frame 15 is provided with a U-shaped cassette groove or cassette pocket 20, beneath one flat side of the panel 12 so that a cassette 11 can be slidably received in the cassette pocket 20 to thereby form a grid cassette when assembled.

Figure 3:
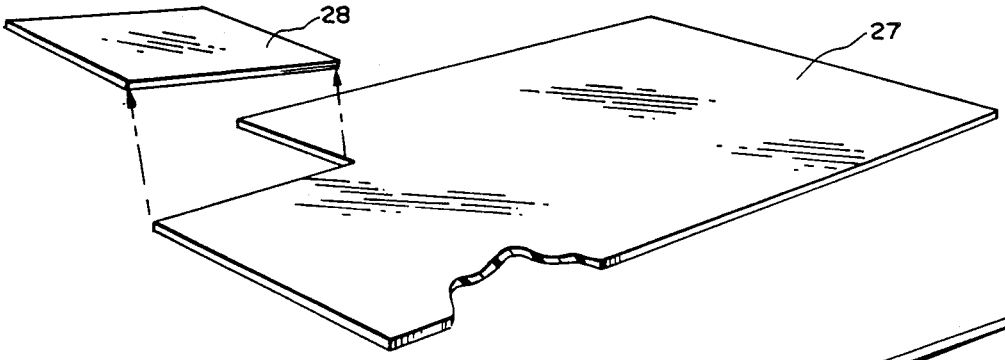
FIG. 3 is an exploded fragmentary view of a first step of forming an X-ray grid structure where a flat plate is cut from a large sheet of raw material.

The X-ray grid structure 10 can be made by different methods, but the preferred method is the one that we have illustrated in FIG. 3–12, inclusive, with the finished product being shown in FIG. 1, 2 and 3.

The material used to form our X-ray grid structure 10 excepting the frame 15 and the fasteners is (Lexan) a polycarbonate, known in the industry for being shatter proof as well as impact resistant. This is the material of choice because of its desirable qualitites.

The material used to form our X-ray grid structure rails (channels) or frame 15 is U.H.M.W. which is Ultra High Molecular Weight polyethylene, which is an impact resistant high density material. Other suitable materials that can be substituted are "Delrin" and Acetal or H.D.P.E. (high density polyethylene) both of which have similar qualities as U.H.F.W; their differences being related to cost and durability.

Figure 4:
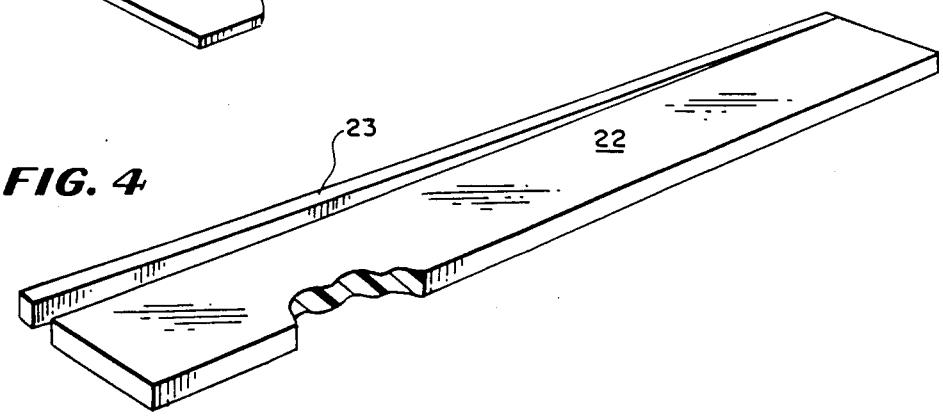
FIG. 4 is an enlarged fragmentary prospective view showing the way in which stock for forming a frame member or rail is cut from a strip of raw material.
Figure 5:
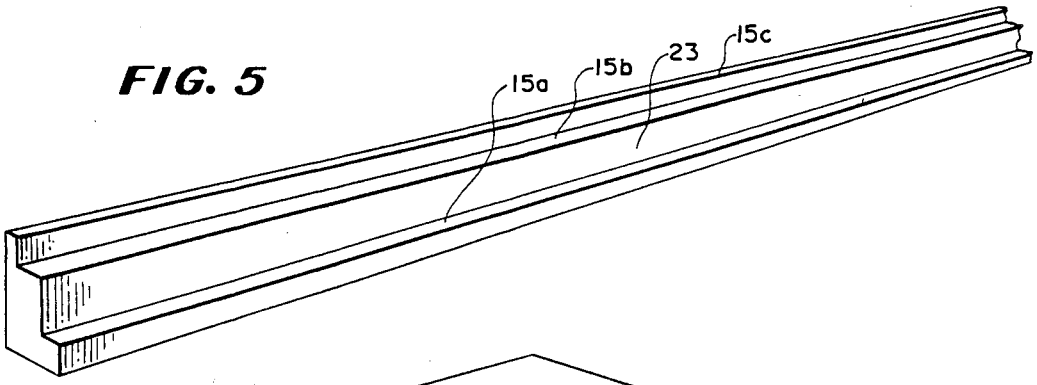
FIG. 5 is an enlarged fragmentary prospective view showing the frame member after it has been machined to provide a series of steps.
Figure 7:
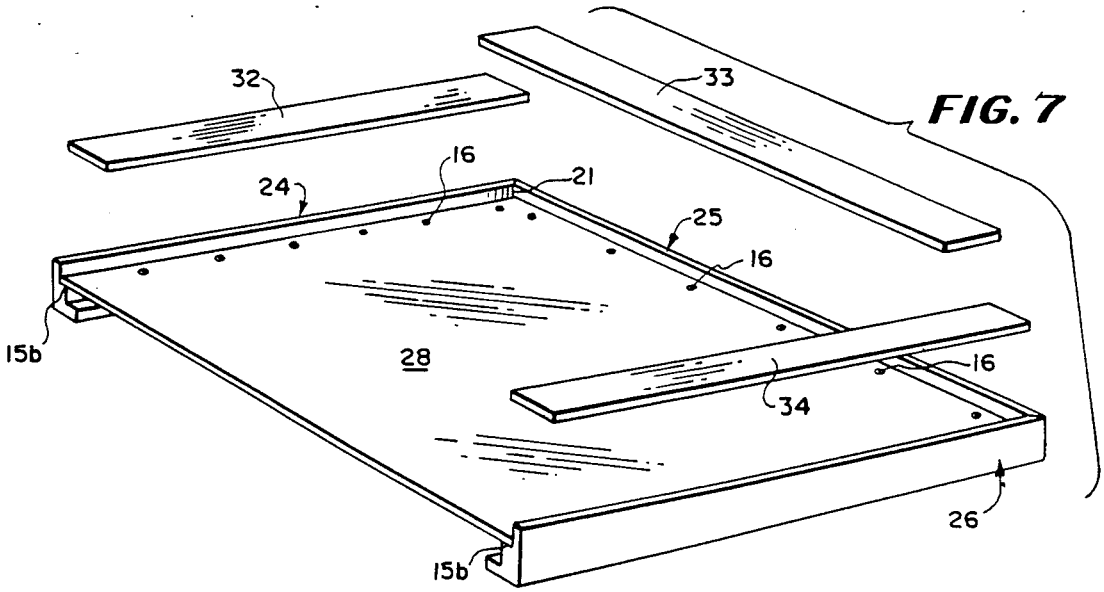
FIG. 7 is an enlarged exploded view of the assembled components shown in FIG. 6 and with additional components positioned in readiness for assembly with the assembled subassembly shown in FIG. 6.

The method may be performed by securing 4×8 sheets 22 of UHMW (FIG. 4), and the 4×8 sheets are then cut into strips 23 having the dimensions of 1-⅜×1" FIGS. 4 and 5. Then those strips 23 are cut to form three individual frame channels or rails 24, 25, and 26 (FIG. 6). Those channels or rails are then cut with a miter saw into a usable size, depending upon the size of the X-ray grid structure 10 to be manufactured. The mitered joints are indicated at 21 (FIG. 7).

Figure 11:
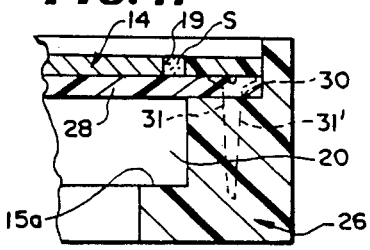
FIG. 11 is an enlarged fragmentary cross sectional view take taken on the line 11—11 looking in the direction indicated by the zeros as seen in FIG. 10.

Then preferably using a polycarbonate such as "Lexan", panel structure 12 is made. Using 4×8 sheets as indicated at 27 (FIG. 3), these sheets 27 are cut into varying sizes of smaller plates or sheets 28 and 29 (FIG. 12) according to the size of the X-ray grid structure to be manufactured. The plates or sheets 28 and 29 are cut approximately ½" wide and ½" longer than the cassette 11 to be assembled with the X-ray grid structure 10. The plate or sheet 28 is then drilled on three sides including the back and two sides with a No. 37 drill size to provide plate holes 30. Then the rails 24, 25 and 26 are fit around three sides of the lower base plate or sheet 28, and are redrilled with a No. 37 drill through the plate 28 and its holes 30 into the rails 24, 25 and 26, so rail holes 31 coincide with plate holes 30 (FIG. 11). Pins are used to align and secure the mitered pieces against movement. The rails are tapped and the holes cleaned out. The plate 28 is drilled with a 9/64" clearance hole 30 and then that same plate 28 is counter bored through a ⅜" counter bore to accept the flat head screw 16. At this time the miters are then drilled with No. 37 holes 31 (FIG. 14) through the miters (FIG. 6), cleaned out, run with a 9/64" clearance hole, run with a ¼" counter bore, and then tapped. A screw 31 is then inserted and a silicone dab is added to its exposed end to make it flush.

The plate 28 is then assembled with the U-shaped frame 15 by engaging an outer marginal 3-sided edge area upon the U-shaped middle frame or rail ledge **15*b* above the lower edge 15*a* and beneath the top ledge 15*c*. The screws 16 are used to secure the plate to the U-shaped frame ledge 15*b***.

Figure 9:
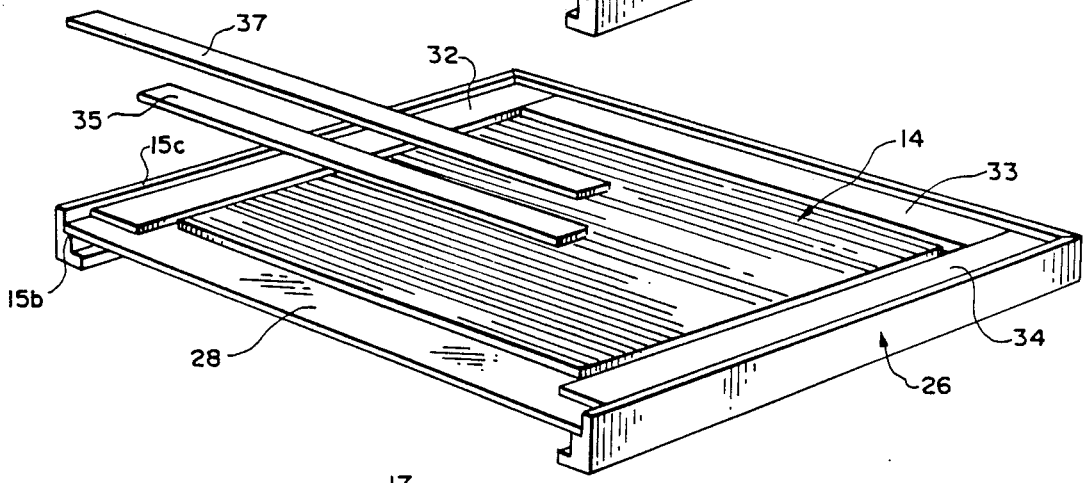
FIG. 9 is an enlarged prospective view similar to FIG. 8 only showing the sub-assembly of FIG. 8 and the grid being in assembled relations, and further illustrating other strips being illustrated in exploded relation preparatory for assembly.

The main housing of the shell is now ready for installation of filler strips or stops 32, 33, 34 and 35 (FIG. 9). The three strips or stops 32, 33, 34, are bonded in place with methalyne chloride, which is a fast acting bonding agent to the plate 28. Then there are 2 screws 36 (FIG. 10) placed in the opening strip 35 to the left and right side of the opening approximately ½" back, and the same process is done, No. 37 screw No. 9/64" for clearance and then a ⅜" counter bore and two screws are placed in here to give the rail additional strength because that screw penetrates through the filler strip and bottom plate through to two pieces of material instead of just one giving it double strength.

Figure 8:
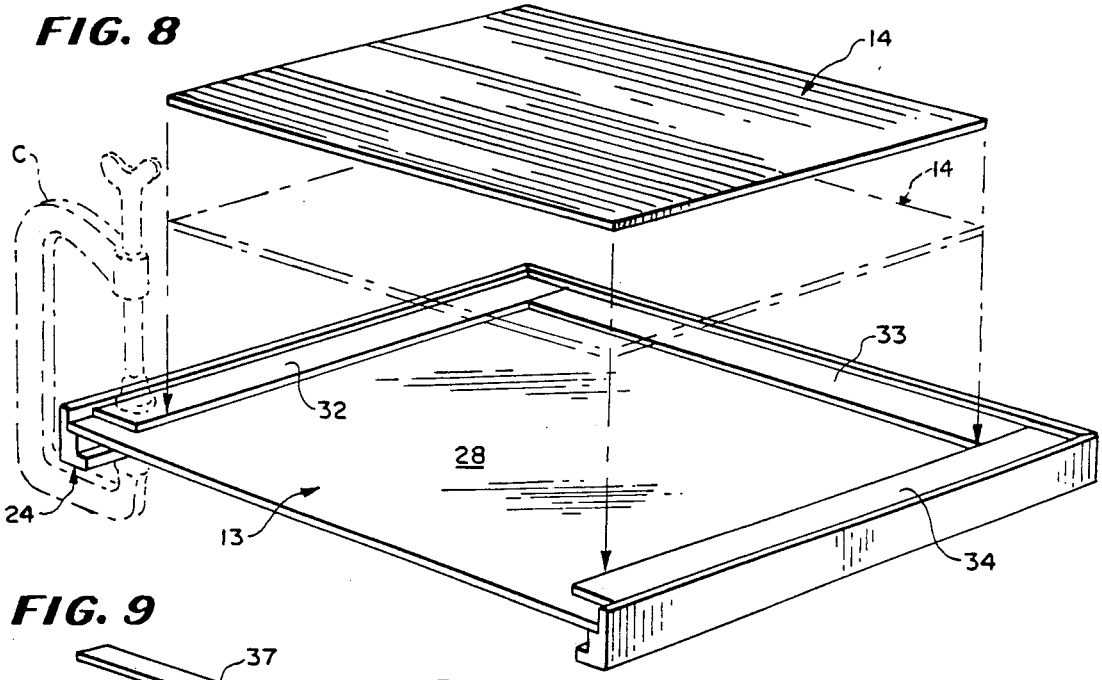
FIG. 8 is an enlarged prospective view showing the components in the sub-assembly illustrated in FIG. 7 in assembled relation and with a grid being illustrated in full and dotted lines, showing the way that it can be assembled with the sub-assembly.
Figure 10:
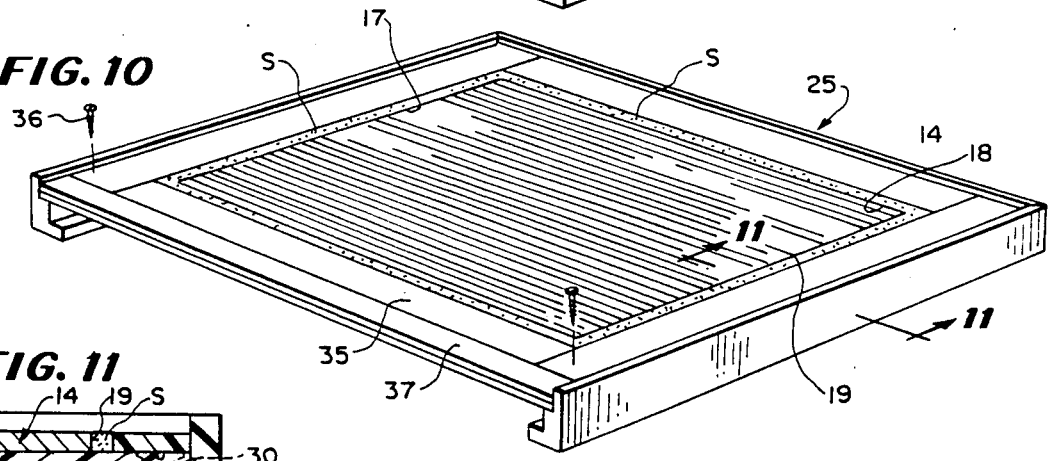
FIG. 10 is a further prospective view similar to FIG. 9 only showing the exploded components in assembled position on the sub-assembly illustrated in FIG. 9.

Now we would add the front filler strip 35. In order to secure the front filler strip 35, a piece of plywood dummy plate (not shown) is used to hold the front filler strip in a predetermined position. To this end, we put the plywood plate in and then the front filler strip 37 is clamped in by suitable clamps C, as seen in FIG. 8). After the glue is dried, the plywood plate is removed. Then the grid 14 is inserted. The four sides around the grid are then caulked with silicones in the gap between the grid 14 and the filler strips 32, 33, and 34 (FIGS. 10 & 11). After the silicone becomes hard, a second white filler strip 37 is glued in the front to provide the X-ray grid structure with a totally white exterior coloration. After the glued components are dry, the excess mastic is cut off, the excess plastic is removed, and the white edge of the UHMW edge of the white filler strip is sanded down. Then mastic is sprayed on the grid, and a piece of white paper is placed on the grid (not shown) to conceal and to eliminate the darker color of the grid providing a desired aesthetic appearance to the product. The next step is to place the top plate 29 into position. Before the top plate 29 is bonded all four sides of the filler strips 32, 33, 34 and 35 are coated with ethylene dichloride, a slower bonding agent, which allows time for the fabricator to position the top plate 29. Since a tight drop in fit is vital to proper impact distribution of the product, it is important that you have time to place the top plate 29 in position properly. All four (4) sides are preferably clamped individually, and the ethylene dicloride gives you about 30 seconds–40 seconds.

Regarding the front filler strips 35 and 37, two strips are utilized. The first strip 35 is clear, the scond strip 37 is white.

The white strip 37 is applied to the outer edge of the X-ray grid structure to complete the white coloration, the clear strip is used for permanent bonding purposes.

The clear Lexan will bond permanently to the white Lexan creating a non-breakable entity.

White "Lexan" is (a trademark of General Electric Company) is coated with an ultra violet covering which will not allow for permanent bonding.

Therefore, to allow for a finished exterior completely in white, two filler strips are utilized. A white strip 37 to theoutside edge for coloration and a clear strip 35 directly parallel to the white strip for purposes of permanent bonding strength.

At this time, a rough finish X-ray grid structure 10 has been completed. We now place this structure 10 upside down on a bench saw and the projecting plastics projecting beyond the rail, are all cut at one time, the lower, the middle and the upper section, and the rail itself is cut to one dimension, which makes all three pieces smooth. Then a router is used with a 3/16 radius and we radius both back miters, the front edges, 3 inside edges, 4 outside edges on the bottom, 4 edges on the top, 3 edges of the rail,and the base, and the inside radius on the base is done with a ⅛"radius. After completing this step, the front is sanded down to take the saw and router marks out of it. The joints are now rubbed smooth and metyl chloride is used across the face to bring the shine back so the whole unit looks as one. From there a centering arrow is placed on it to show the center reference of the grid, and labels are secured onto the product.

We claim:

1. An X-ray grid structure for assembly with a cassette comprissing a rectangular, flat panel comprised of a polycarbonate material and having an interior closed panel pocket, an X-ray grid protectively encased in said interior panel pocket of said flat panel so as to be protected therein against impact forces when applied to said panel, a frame around three side edges of said panel, said frame being comprised of a UHMW plastic for cushioning impacts, means securing said frame to said flat panel along said three side edges but with said securing means being spaced from said grid at its outer peripheral edges, and a groove in said frame forming a cassette pocket beneath one flat side of said panel for a cassette to be slidably received in the cassette pocket so as to form a grid cassette when assembled.

2. The X-ray grid structure of claim 1 further characterized by said flat panel being comprised of a pair of flat panel plates stacked on top of one another, the flat plates stacked on top of one another, the flat panel plates being spaced from one another by spacers positioned between the plates at the perimeter of the grid and co-acting with the panel plates to provide the interior closed panel pocket for receiving the X-ray grid.

3. The X-ray grid structure of claim 1 further characterized by said frame having three vertically spaced steps along inside edges of the frame, the flat panel resting on a middle one of the steps of the frame and with a top surface of the panel lying in coplanar relation with a top one of the steps, and the lower of the steps providing a U-shaped three sided support for receiving a cassette.

4. The structure as set forth in claim 1 wherein the panel is comprised of acrylic.

5. The structure of claim 2 further characterized by the frame being comprised of UHMW plastic with the grid being further cushioned at its outer perimeter to resist impact thereto.

6. The structure of claim 1 further characterized by the frame being comprised of UHMW plastic with the grid being further cushioned at its outer perimeter to resist impact thereto.

7. The X-ray grid structure of claim 1 further characterized by said flat panel being comprised of a pair of flat panel plates stacked on top of one another, spacer means separating the flat panel plates in spaced relation to one another at ther perimeter of the grid and co-acting with the panel plates to provide said interior closed panel pocket for receiving the X-ray grid and fiber cushioning means at the perimeter of the grid in the closed panel pocket to further dampen impact to the grid.

8. The X-ray grid structure of claim 1 further characterized by said frame being U-shaped and having three vertically spaced steps along inside edges of the frame, the flat panel resting on a middle one of the steps of the frame and with a top surface of the panel lying in co-planar relation with a top one of the steps, and the lower of the steps providing a three sided U-shaped support for receiving an outer margin of a cassette.

9. The X-ray grid structure of claim 1 further characterized by said frame being U-shaped and including three separate strips having mitered ends, and means securing the mitered ends in U-shaped relation to one another.

10. The X-ray grid structure of claim 1 further characterized by said frame having three vertically spaced steps along inside edges of the frame, said flat panel being comprised of a pair of flat upper and lower panel plates stacked on top of one another, spacer means separating the flat panel plates in spaced relation to one another at the perimeter of the grid and co-acting with the panel plates to provide said interior closed panel pocket for receiving the X- ray grid cassette, the lower panel plate and attachment means securing the upper plate in assembly with the panel.

11. An X-ray grid structure for assembly with a cassette comprising a rectangular, flat panel comprised of a polycarbonate material and having an interior permanently closed panel pocket, an X-ray grid protectively encased in said interior permanently closed panel pocket of said flat panel so as to be protected therein against impact forces when applied to said panel, a frame around three side edges of said panel, said frame being comprised of a UHMW plastic for cushioning impacts, means securing said frame to said flat panel along said three side edges, and a groove in said frame forming a cassette pocket beneath one flat side of said panel for a cassette to be slidably received in the cassette pocket so as to form a grid cassette when assembled.

12. The X-ray grid structure of claim 11 further characterized by a cassette being slidably mounted in said groove in removable assembly therewith to form a grid cassette.

13. The X-ray grid structure of claim 11 further characterized by said flat panel being comprised of a pair of flat panel plates stacked on top of one another, the flat panel plates being spaced from one another by spacers positioned between the plates at the perimeter of the grid and co-acting with the panel plates to form the interior closed panel pocket for receiving the X-ray grid cassette.

14. The X-ray grid structure of claim 11 further characterized by said frame having three vertically spaced steps along inside edges of the frame, the flat panel resting on a middle one of the steps of the frame and with a top surface of the panel lying in coplanar relation with a top one of the steps, and the lower of the steps providing a U-shaped three sided support for receiving a cassette.

15. The X-ray grid structure of claim 11 further characterized by said frame being U-shaped and having three vertically spaced steps along inside edges of the frame, the flat panel resting on a middle one of the steps of the frame and with a top surface of the panel lying in co-planar relation with a top one of the steps, and the lower of the steps providing a three sided U-shaped support for receiving an outer margin of a cassette.

16. The X-ray grid structure of claim 13 further characterized by the spacers being fixedly located in spaced essentially co-planar relation to an outer marginal area of the grid leaving a gap there between on at least three sides of the grid, and silicone being located in the gap as a motion dampening means.

* * * * *